343-700 MS AU 251 EX
10/16/84 OR 4,477,813

United States Patent [19]
Weiss

[11] Patent Number: 4,477,813
[45] Date of Patent: Oct. 16, 1984

[54] MICROSTRIP ANTENNA SYSTEM HAVING NONCONDUCTIVELY COUPLED FEEDLINE

[75] Inventor: Michael A. Weiss, Nederland, Colo.

[73] Assignee: Ball Corporation, Muncie, Ind.

[21] Appl. No.: 407,079

[22] Filed: Aug. 11, 1982

[51] Int. Cl.[3] ..... H01Q 1/38
[52] U.S. Cl. ..... 343/700 MS; 343/829
[58] Field of Search ..... 343/700 MS, 829, 830, 343/846, 705, 767, 768, 770

[56] References Cited

U.S. PATENT DOCUMENTS

| | | | |
|---|---|---|---|
| Re. 2,929 | 7/1977 | Krutsinger | 343/700 MS |
| Re. 29,911 | 2/1979 | Munson | 343/700 MS |
| 3,016,536 | 1/1962 | Fubini | 343/700 MS |
| 3,573,831 | 4/1971 | Forbes | 343/705 |
| 3,713,162 | 1/1973 | Munson | 343/705 |
| 3,757,342 | 9/1973 | Jasik et al. | 343/846 |
| 3,810,183 | 5/1974 | Krutsinger et al. | 343/708 |
| 3,811,128 | 5/1974 | Munson | 343/846 |
| 3,921,177 | 11/1975 | Munson | 343/846 |
| 3,938,161 | 2/1976 | Sanford | 343/829 |
| 3,971,032 | 7/1976 | Munson | 343/700 MS |
| 3,978,487 | 8/1976 | Kaloi | 343/829 |
| 4,012,741 | 3/1977 | Johnson | 343/700 MS |
| 4,051,477 | 9/1977 | Murphy et al. | 343/700 MS |
| 4,054,874 | 10/1977 | Oltman, Jr. | 343/700 MS |
| 4,070,676 | 1/1978 | Sanford | 343/700 MS |
| 4,130,822 | 12/1978 | Conroy | 343/700 MS |
| 4,131,894 | 12/1978 | Schiavone | 343/700 MS |
| 4,180,817 | 12/1979 | Sanford | 343/700 MS |
| 4,197,545 | 4/1980 | Favaloro et al. | 343/700 MS |
| 4,233,607 | 11/1980 | Sanford et al. | 343/700 MS |
| 4,259,670 | 3/1981 | Schiavone | 343/700 MS |
| 4,320,401 | 3/1982 | Schiavone | 343/700 MS |
| 4,426,649 | 1/1984 | DuBost et al. | 343/700 MS |

FOREIGN PATENT DOCUMENTS 2046530 11/1980 United Kingdom ..... 343/700 MS

*Primary Examiner*—Eli Lieberman
*Assistant Examiner*—Michael C. Wimer
*Attorney, Agent, or Firm*—Gilbert E. Alberding

[57] ABSTRACT

A microstrip antenna system having one or more conductively isolated resonantly dimensioned radiator structures disposed less than about one-tenth wavelength above a ground plane is nonconductively coupled to an intermediate layer of microstrip feedline structure. The microstrip feedline structure includes various microstrip transmission line segments fed with reference to the ground plane and including predetermined coupling locations positioned an odd integer number of one-fourth wavelength(s) from an effective r.f. short circuit to the underlying ground plane. Such coupling locations are also disposed proximate a predetermined corresponding feedpoint region of the radiating structure such that electromagnetic fields concentrated at the coupling location operate to nonconductively couple r.f. energy to/from the radiator structure from/to the feedline structure. The coupling location is preferably disposed at a widened and relatively lowered r.f. impedance coupling tab segment of the transmission line having a width dimension which is sufficient to provide matched impedance coupling to the corresponding feedpoint region but which is also substantially less than the dimension of the radiator structure transverse to its resonant dimension. The effective r.f. short circuit may be provided by an actual conductive connection to the underlying reference surface or by an r.f. open circuit termination located an additional one-fourth wavelength therefrom along the feedline structure.

23 Claims, 13 Drawing Figures

MICROSTRIP ANTENNA SYSTEM HAVING NONCONDUCTIVELY COUPLED FEEDLINE

This application is generally directed to microstrip antenna systems formed by one or more resonant dimensioned radiator structures disposed less than one-tenth wavelength (at the intended antenna operating frequency) from an underlying ground plane or reference surface. More specifically, it is directed to a microstrip antenna system of this type having feed transmission lines that are nonconductively coupled to the resonant dimensioned radiator structure(s).

Microstrip antenna systems employing resonant dimensioned conductive areas usually disposed less than about one-tenth wavelength from an underlying ground or reference surface are well known in the prior art. For example, reference may be had, among others, to the following prior issued U.S. patents commonly assigned with the present application to Ball Corporation:

U.S. Pat. No. 3,713,162—Munson et al (1973)
U.S. Pat. No. 3,810,183—Krutsinger et al (1974)
U.S. Pat. No. 3,811,128—Munson (1974)
U.S. Pat. No. 3,921,177—Munson (1975)
U.S. Pat. No. 3,938,161—Sanford (1976)
U.S. Pat. No. 3,971,032—Munson et al (1976)
U.S. Pat. No. Re. 29,296—Krutsinger et al (1977)
U.S. Pat. No. 4,012,741—Johnson (1977)
U.S. Pat. No. 4,051,477—Murphy et al (1977)
U.S. Pat. No. 4,070,676—Sanford (1978)
U.S. Pat. No. Re. 29,911—Munson (1979)
U.S. Pat. No. 4,180,817—Sanford (1979)
U.S. Pat. No. 4,233,607—Sanford et al (1980)
U.S. Pat. No. 4,259,670—Schiavone (1981)
U.S. Pat. No. 4,320,401—Schiavone (1982)

All of the just mentioned prior patents disclose exemplary embodiments wherein microstrip antenna system structures have utilized feedline structures that are conductively connected (e.g. either integrally connected microstrip line or by a soldered feed pin to a coaxial feed line, etc.) to the resonantly dimensioned radiator structures which, in cooperation with the underlying ground plane, define a resonant cavity having one or more radiating slots about its edges. However, it should be noted that the Munson '128 patent disclosure includes series capacitance in the feedline structure so as to provide isolation for special DC currents passing through selective segments of the line. In addition, the Sanford '676 patent disclosure teaches a form of electromagnetic coupling between differently dimensioned and stacked radiator structures such that the conductive feedline connections need not always be made to every radiator structure.

Other prior antenna art has also utilized various types of nonconductive coupling between feeding structures and radiating structures. For example, attention is directed to the following examples of prior issued U.S. patents:

U.S. Pat. No. 3,016,536—Fubini (1962)
U.S. Pat. No. 3,573,831—Forbes (1971)
U.S. Pat. No. 3,757,342—Jasik et al (1973)
U.S. Pat. No. 3,978,487—Kaloi (1976)
U.S. Pat. No. 4,054,874—Oltman, Jr. (1977)

Fubini teaches a capacitively coupled colinear stripline antenna array where outer radiator elements are capacitively coupled to their nearest neighbors through a short gap therebetween. The gap is said to be substantially less than a quarter wavelength at the operating frequency while all of the elements are disposed in the neighborhood of a quarter wavelength above a ground plane.

Forbes describes his antenna as a proximity fuse microstrip antenna; however, it actually comprises a very narrow (e.g. a wire) resonant length (e.g. one-half wavelength) element disposed closely above a half wavelength microstrip transmission line having r.f. open circuits at each end and split in the middle where a pair of connections are provided to an r.f. generator. The microstrip line is in turn also quite closely spaced (on the order of 0.01 wavelength) from a ground or reference surface.

Jasik teaches a colinear array which includes alternating half wavelength long segments of wide and narrow microstrip transmission line. Two such transmission line structures are disposed one above the other and offset longitudinally with respect to one another above a ground plane such that a wide portion of the top transmission line overlies a narrow portion of the intermediate transmission line and vice-versa. Radiation is said to occur from the gaps formed between the ends of the staggered wide sections of the top and intermediate line. The pair of lines appear to be disposed a considerable distance above a ground plane although specific dimensions in terms of wavelength are not explicitly discussed.

Kaloi teaches a nonconductively fed microstrip antenna with a microstrip "coupler" placed near a resonant radiator structure in a common plane.

Oltman teaches microstrip dipole antenna elements and/or arrays thereof which are nonconductively coupled to an intermediate microstrip transmission line also disposed above a common ground plane. Oltman appears to utilize either a constant width transmission line (where the width is substantially greater than the non-resonant width of the dipole radiator element) or corporate structured lines having tab terminations near the coupling points that are of approximately the same width dimension as the non-resonant width of the dipole elements.

In spite of these prior art teachings, the most common type of microstrip antenna structures have usually continued to be fed by direct conductive connections to the resonant dimensioned radiator elements. Here, particular reference is made to the type of microstrip antenna which employs two-dimensional conductive radiator areas which each have a resonant dimension of substantially one-half wavelength at an intended operating frequency and also have a substantial transverse dimension so as to define a resonant cavity with one or more radiating apertures in the volume located between the conductive area and a closely spaced (i.e. less than one-tenth wavelength) underlying electrically conductive ground or reference surface. Due to whatever reason (e.g. a possible fear of disrupting the electrically resonant cavity), these types of microstrip antenna structures have typically continued to be fed by direct conductive connections to the resonantly dimensioned radiator elements. Typically, a microstrip transmission line feed network is integrally formed by photo-chemical etching processes in the same layer of conductive material from which the resonantly dimensioned radiator structures are formed. Such a microstrip transmission line system is itself typically fed by a soldered connection to the center conductor of a coaxial cable or a balun structure or the like. Microstrip radiators may also be directly fed by a soldered pin connection to the center conductor of a coaxial cable, etc.

For some specific applications (e.g. radiator altimeter antenna arrays where a receiving array is quite closely spaced to a separate transmitting array on a common conductive surface), spurious radiation occurring directly from the microstrip transmission line structures and/or from protruding soldered pin connections or the like in the same plane as the resonant radiating structures can present severe design constraints. Where such antennas must be cheaply produced in large quantities and must also be designed so as to withstand very high temperatures (e.g. 417° F. for at least fifteen minutes) while simultaneously meeting stringent antenna isolation requirements (e.g. between each of the pair of radio altimeter antennas required on a single aircraft), the conventional conductively connected feedline techniques can present virtually insurmountable electrical and/or mechanical design constraints.

Now, however, I have discovered a novel technique for nonconductively feeding microstrip radiator structures of the above-described type which substantially eliminates and/or alleviates many of the design constraints encountered when using conventional conductive feed connections.

For example, using this new nonconductive feed technique, it is possible to dispose the feedline structure much closer to the ground plane surface than is the resonant dimensioned radiator structure. This results in much less spurious radiation from the feedline structure (e.g. to nearby antenna structures operating on the same or nearby frequencies). At the same time, the feedline structure (and any associated solder connections) is removed to a greater extent from adverse outside environment factors such as temperature.

Since the feedline structure is actually formed on a completely different plane from that of the radiator structure, there is more area available within the feed system for additional circuitry (e.g. phase shifters, etcetera). Overall antenna radiating efficiencies of well over 90% have been realized using this new technique as well as improved bandwidth when compared to similar microstrip radiator structures disposed similar distances above a ground plane.

The microstrip antenna system provided by this invention is of the type which includes a layer of electrically conductive microstrip radiator structures disposed less than one-tenth wavelength above an electrically conducting ground reference surface where the radiator structure includes at least one conductively isolated two dimensional conductive area having a resonant dimension of substantially one-half wavelength. A layer of electrically conductive microstrip feedline structure is then disposed intermediate the reference surface and the layer of radiator structure. The feedline structure includes at least one predetermined coupling location positioned an odd integer number of one-fourth wavelength(s) from an effective r.f. short circuit to the underlying reference surface. The effective r.f. short circuit ensures a concentration of electromagnetic fields at the predetermined coupling location which is, in turn, also disposed proximate a predetermined corresponding feedpoint region of the radiator structure such that the concentrated electromagnetic fields at the coupling location operate to nonconductively couple r.f. energy to/from the radiator structure and from/to the feedline structure.

In the exemplary embodiment, the feedline structure includes strip transmission line segments having different widths and hence different r.f. impedances with respect to the underlying ground plane. The coupling location is preferably disposed at a widened and thus lowered r.f. impedance coupling tab segment of the line having a width dimension sufficient to provide a matched impedance condition at the corresponding feedpoint region of the radiator structure but which width dimension is nevertheless substantially less than the transverse dimension of the radiator structure. The longitudinal axis of such coupling tab segments is presently preferably disposed parallel to the resonant dimension of the overlying radiator structures. However, the device will operate with the tabs perpendicular, or any other way, so long as the coupling location and feedpoint region correspond to a matched impedance condition. Although the coupling locations do not have to be directly under the radiator structures, they should be sufficiently proximate those structures to ensure that the concentrated electromagnetic fields at a coupling location are strongly coupled to a desired feedpoint of the resonantly dimensioned radiator structures.

The effective r.f. short circuit in the feedline structure may be provided directly by a conductive connection to the underlying reference surface or by an r.f. open circuit termination located one-fourth wavelength therefrom. In the first case, the coupling tab segment preferably has a length of one-fourth wavelength while in the latter instance the coupling tab segment preferably has a length of approximately one-half wavelength.

The ground or reference surface and the feedline structure may be provided by metallically-cladded opposite sides of a first dielectric sheet, one side of which is photochemically etched so as to form the required feedline structure. The radiator structure may be similarly provided by photochemically etching a metallically-cladded side of a second dielectric sheet. In one exemplary embodiment, two such sheets are spaced apart by an expanded dielectric structure (e.g. honeycomb shaped) and the distance between the feedline structure and the reference surface is on the order of one-fourth the distance between the radiator structure and the reference surface.

These as well as other objects and advantages of this invention will be better understood and appreciated by a careful study of the following detailed description of the presently preferred exemplary embodiments of this invention taken in conjunction with the accompanying drawings, of which:

Figure 1:
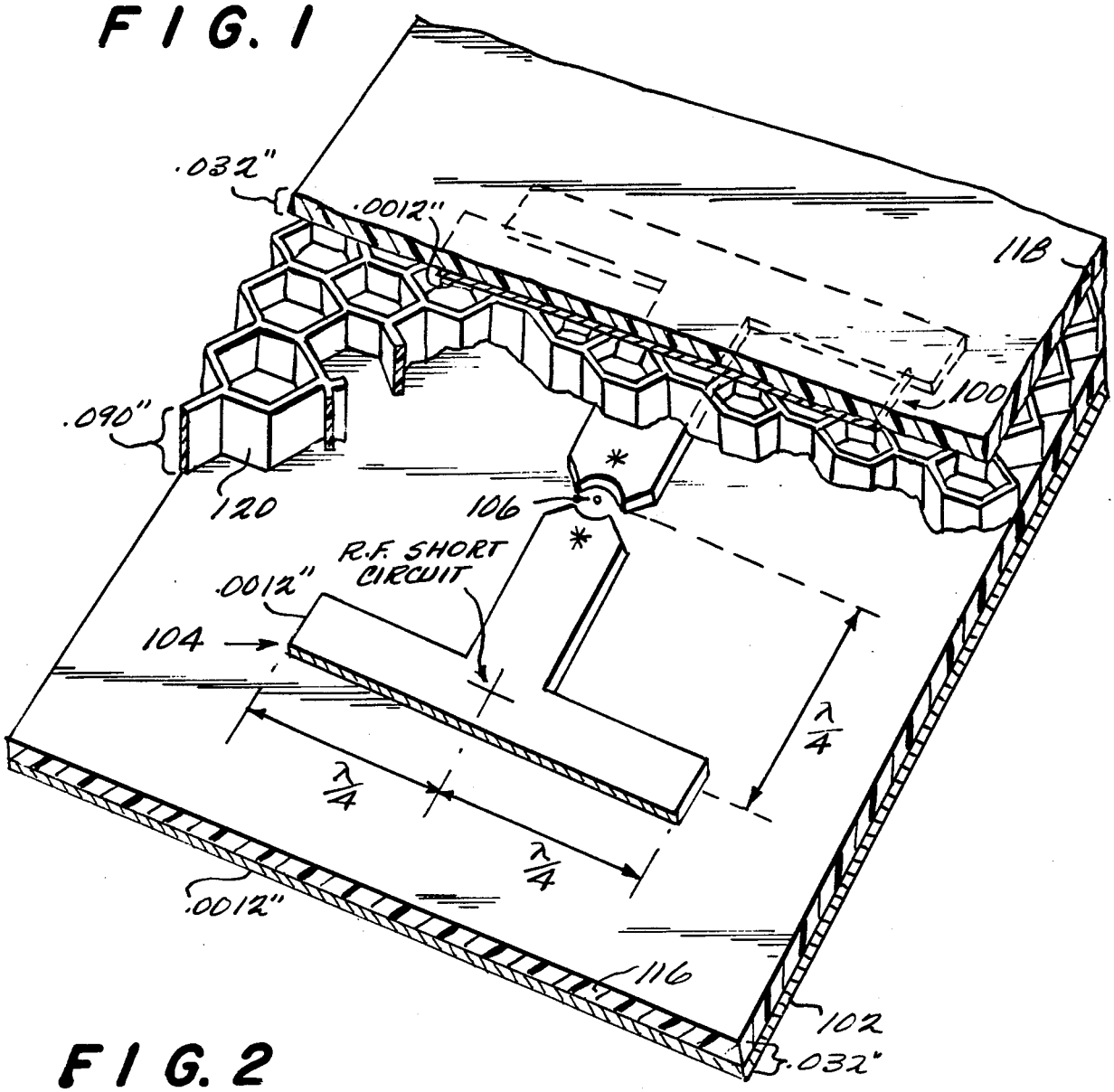
FIG. 1 is a cut away perspective view of one exemplary embodiment of this invention fed by a balun.
Figure 2:
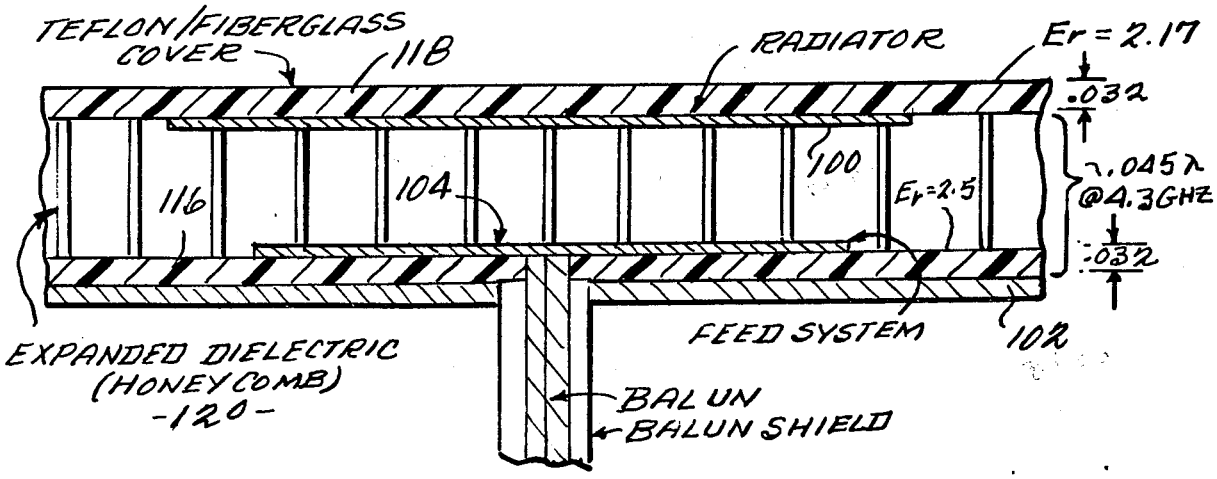
FIGS. 2 and 3 are cross-sectional and plan views of the embodiment shown in FIG. 1.
Figure 3:
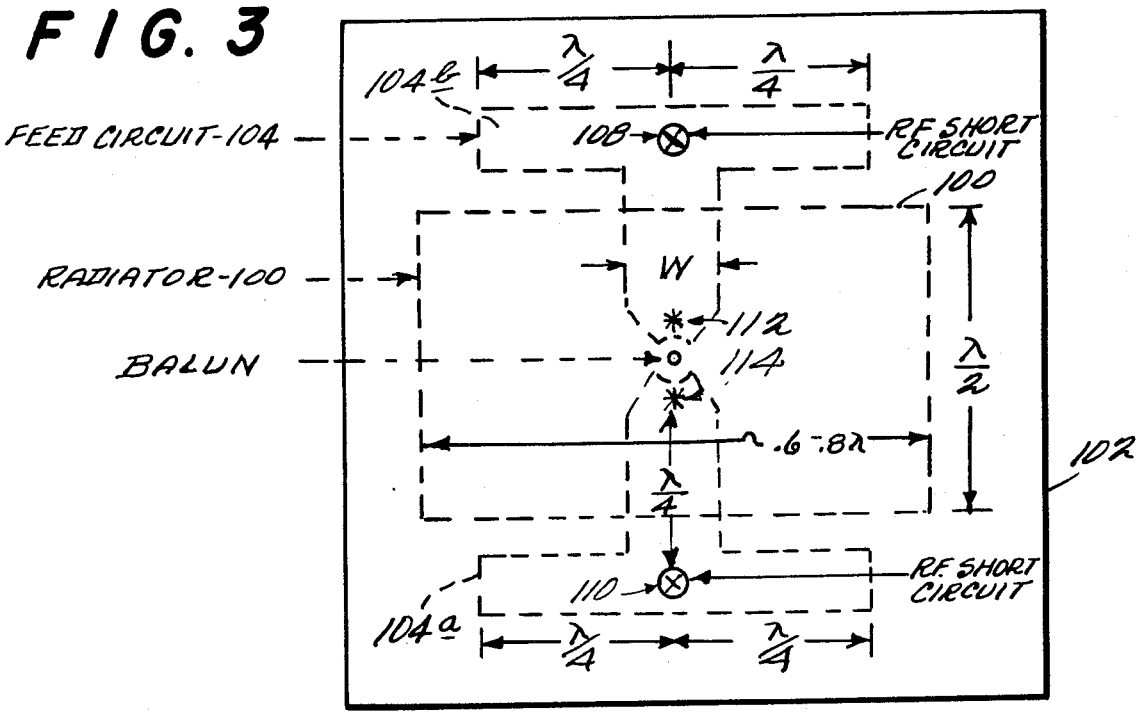
Figure 4:
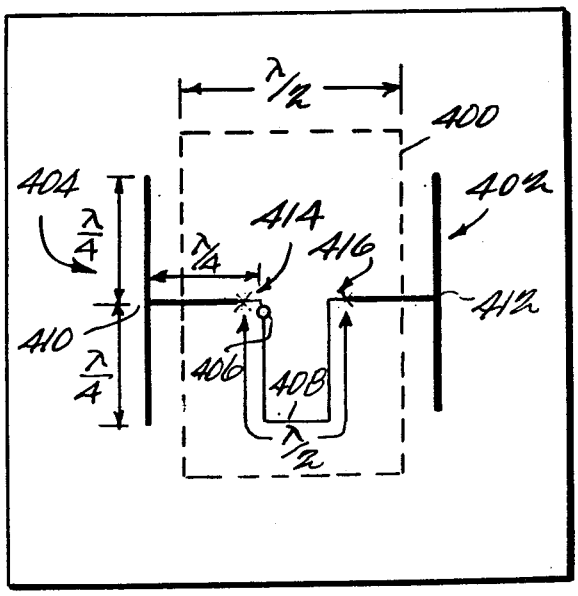
Figure 5:
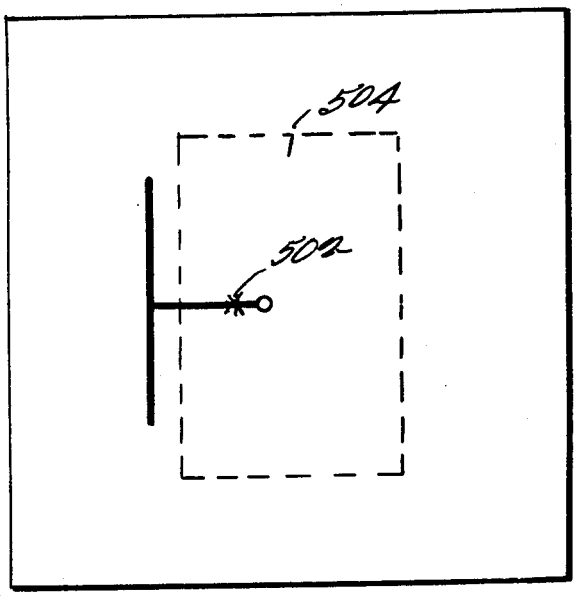
Figure 6:
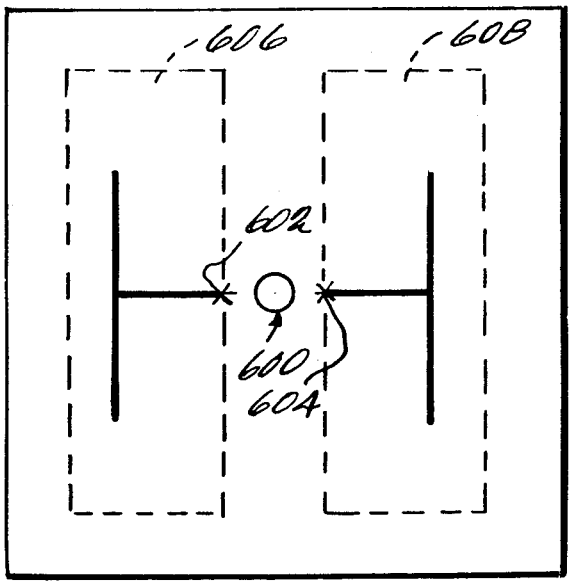
Figure 7:
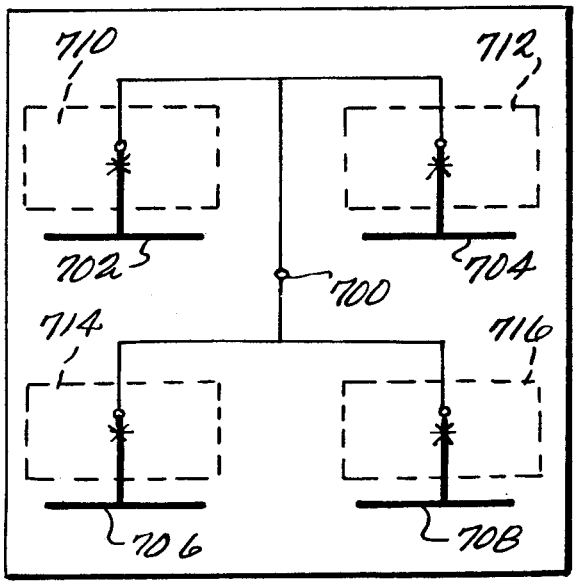
Figure 8:
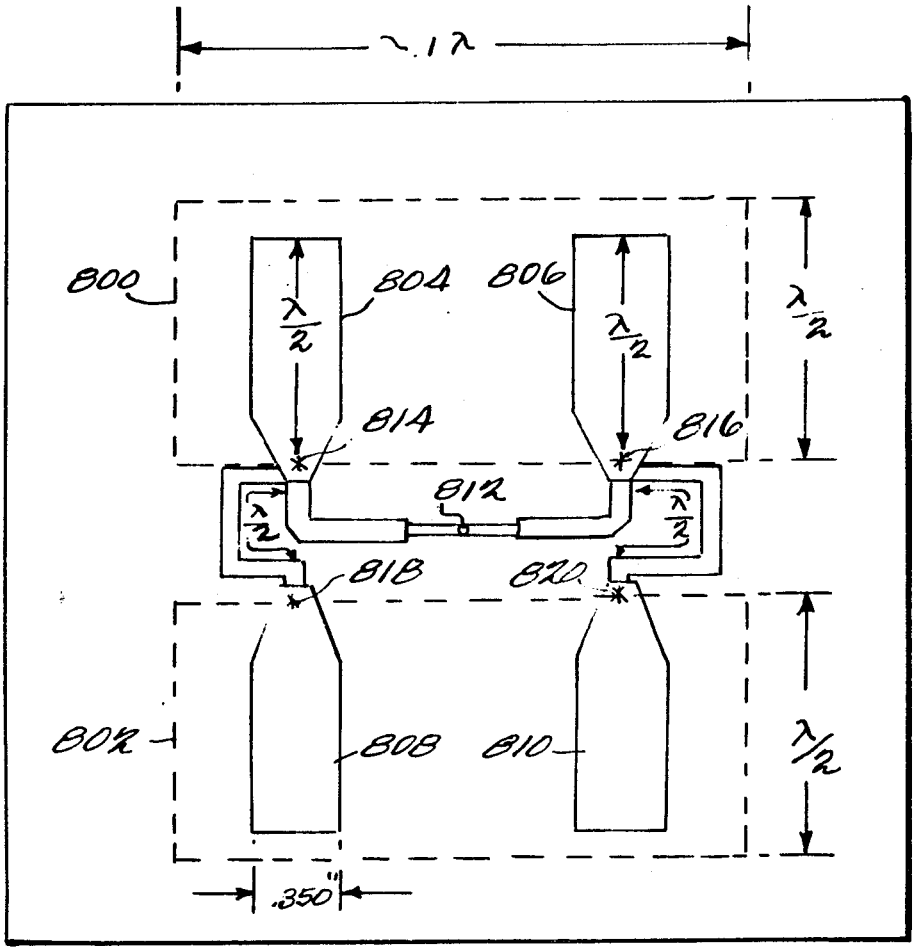
Figure 9:
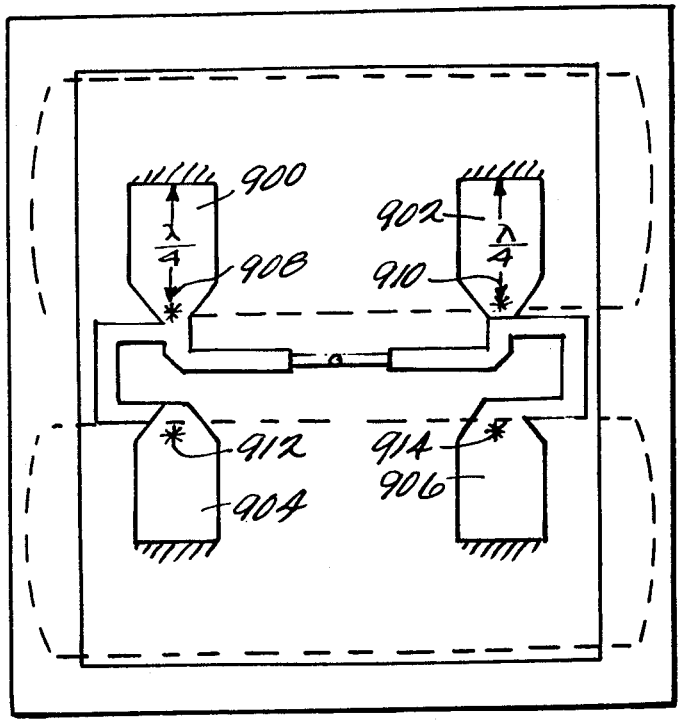
Figure 10:
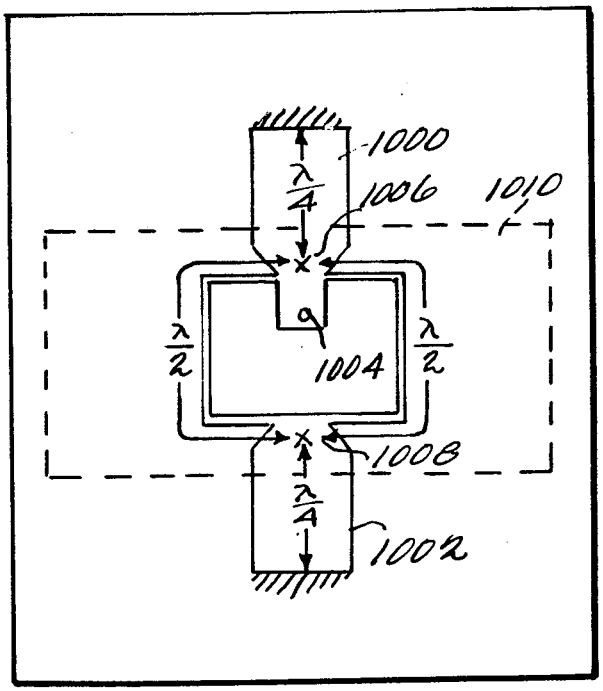
Figure 11:
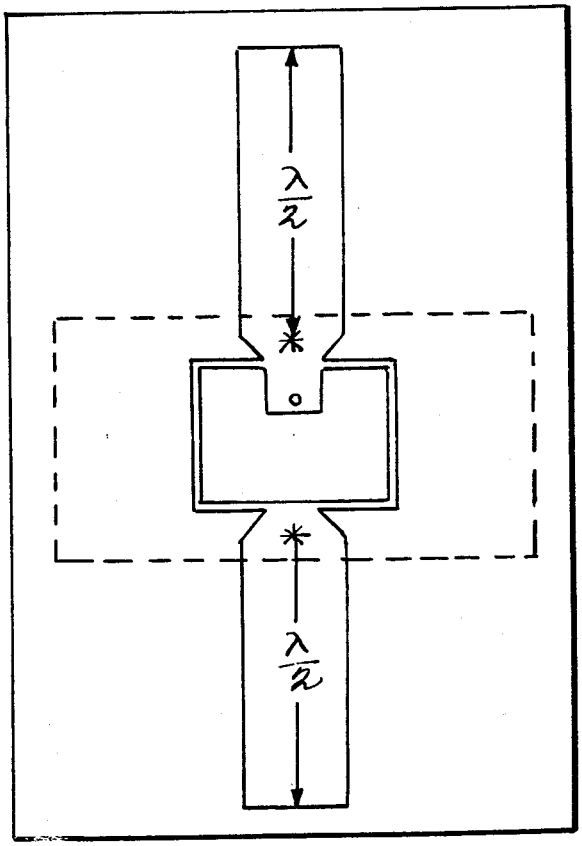
Figure 12:
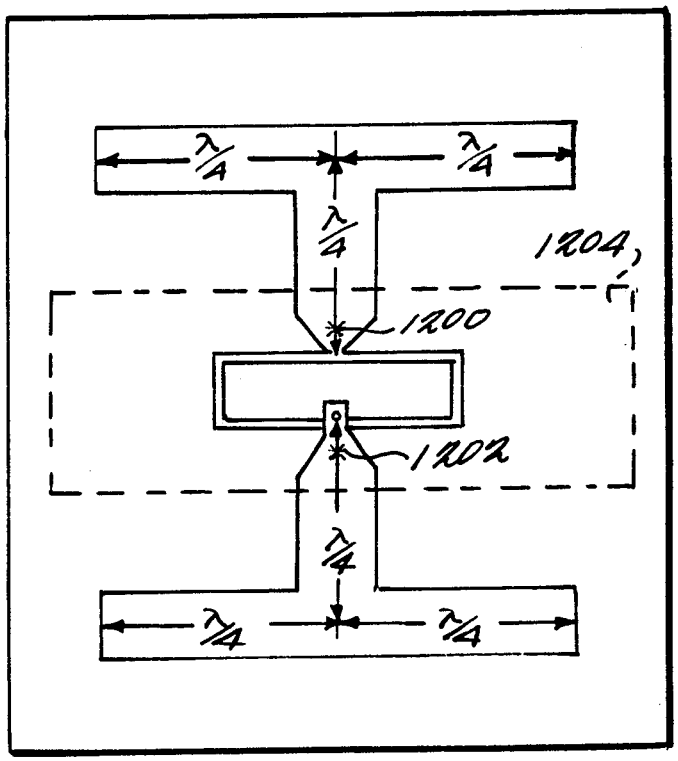
Figure 13:
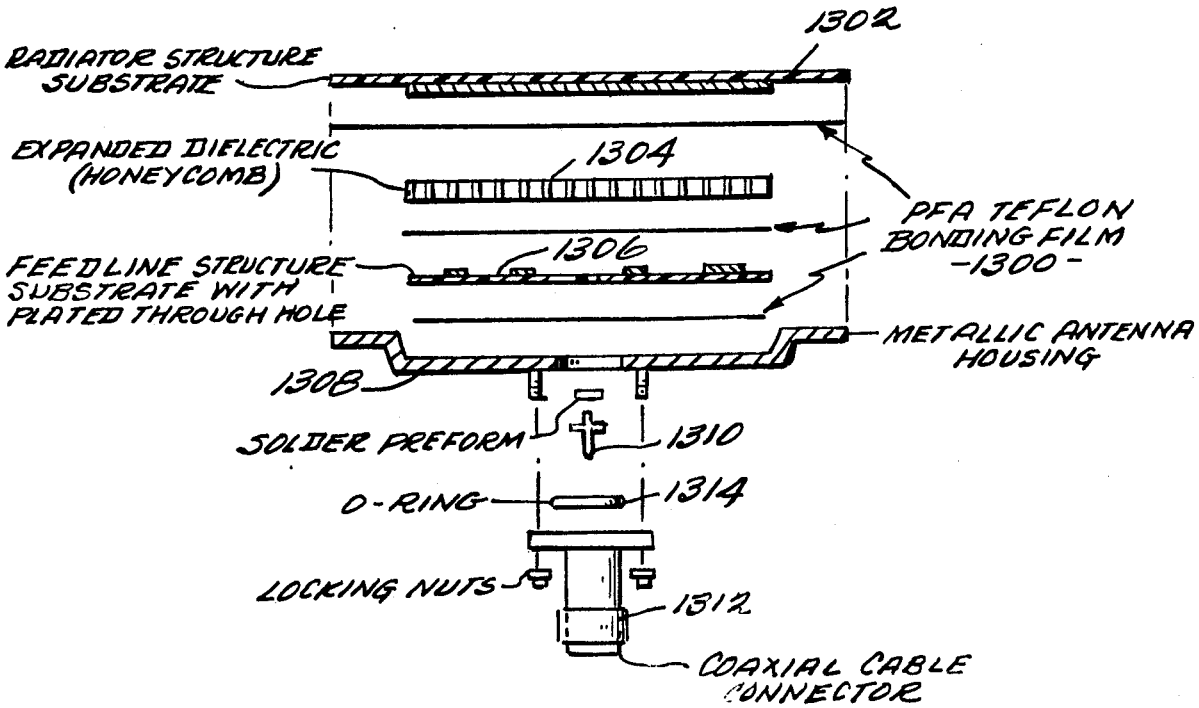

FIGS. 4 and 5 constitute schematic plan views of alternate single radiator embodiments analogous in other respects to the FIGS. 1-3 embodiment but fed by an unbalanced line;

FIG. 6 is a schematic plan view of an alternate dual radiator element embodiment of this invention fed by a balun and having a layered general construction similar to that of FIGS. 1-3;

FIG. 7 is a schematic plan view of an alternate array embodiment of this invention fed by an unbalanced line and having a single nonconductive feed coupling to each radiator element in the array and a layered general construction similar to that of FIGS. 1-3;

FIG. 8 is a plan view of an extended length dual microstrip radiator array generally similar to FIGS. 1-3 but having plural nonconductively coupled feedpoints on each radiator element fed by an unbalanced line and with a special feedline structure having widened coupling tab portions that are terminated by r.f. open circuits;

FIG. 9 is a plan view of yet another alternate embodiment similar to that of FIG. 8 but including a special feedline structure fed by an unbalanced line and having widened coupling tab sections that are terminated in conductive r.f. short circuits to the underlying ground plane;

FIG. 10 is an alternate embodiment for a single microstrip radiator patch similar to the FIGS. 1-3 embodiment but fed by an unbalanced line and having coupling tab portions which terminate in conductive r.f. short circuits to the underlying ground plane;

FIG. 11 is a plan view of yet another embodiment similar to that of FIG. 10 but having coupling tab portions which terminate in an r.f. open circuit analogous to that of the FIGS. 1-3 embodiment;

FIG. 12 is a plan view of an embodiment similar to the FIGS. 1-3 embodiment but fed by an unbalanced feedline rather than by a balun; and FIG. 13 is an exploded cross-sectional view of the mechanical parts which may typically be included in the construction of any of the embodiments of FIGS. 1-12.

FIGS. 1-3 depict a single resonant dimensioned microstrip radiator area 100 disposed a distance less than one-tenth wavelength above a ground plane or reference surface 102. Typically, the radiator 100 has a resonant dimension of one-half wavelength and a transverse dimension on the order of 0.6-0.8 wavelength at the intended antenna operating frequency. The transverse nonresonant dimension may be varied for different applications in accordance with known microstrip antenna design principles and/or the entire shape of the resonant dimensioned microstrip radiator structure 100 may be substantially changed from the rectangular shape shown in FIGS. 1-3 in accordance with known microstrip antenna design practices. In any event, the radiator structure 100 does have a resonant dimension and defines a resonant cavity in the volume located between the radiator and the ground plane structure 102. One or more edges of the radiator element typically defines a radiating slot with respect to the underlying ground plane surface from which radio frequency energy is transmitted/received. In the embodiment of FIGS. 1-3, a pair of such radiating slots is defined by the opposite parallel edges of radiator element 100 directed transversely to the one-half wavelength resonant dimension.

In addition to the layer of radiator structure 100 disposed above ground plane 102, the embodiment of FIGS. 1-3 includes a layer of microstrip feedline structure 104 disposed even more closely above ground plane 102. The symmetric but oppositely disposed transmission line segments **104*a* and 104*b* are fed at the center of the structure by a conventional balun feed. The extreme terminals of the transmission lines 104*a* and 104*b* terminate in r.f. open circuits. Since each horizontal arm of each "T" portion is one-fourth wavelength at the intended antenna operating frequency, this transforms back to an effective r.f. short circuit at point 108 and at point 110. The vertical leg of each "T" line segment is also one-quarter wavelength long at the intended operating frequency. Accordingly, a relatively high concentration of electromagnetic fields is produced in the vicinity of predetermined coupling locations 112, 114 near the center of the structure. In the exemplary embodiment of FIGS. 1-3, such coupling locations are also disposed immediately below the center portion of the radiator 100 and are sufficiently proximate thereto so as to effect a strong electromagnetic coupling from the feedline structure 104 to the radiator structure 100**.

One operating embodiment in accordance with FIGS. 1-3 has been constructed with a center operating frequency of 4.3 gigahertz. (Throughout this application, when reference is made to the intended antenna operating frequency, it will be understood that reference is being made to the center design frequency for the antenna structure and that in actual practice the antenna will have a finite bandwidth of operating frequencies thereabout.)

For this particular model, the radiator 100 was disposed approximately 0.045 wavelength above the ground plane 102 while the feedline structure was disposed only approximately 0.011 wavelength (i.e. 1/32 of an inch) above the ground plane 102. The feed system 104 may be photochemically etched from a copper clad side of a dielectric substrate 116 (e.g. Teflon/fiberglass having a relative permittivity of 2.5) and the relevant dimensions of the feedline system in terms of wavelength are referenced to electrical wavelengths within the dielectric substrate 116. The ground plane 102 may, if desired, also be formed by a copper clad opposite surface of dielectric sheet 116 as should be appreciated.

The radiator structure 100 in FIGS. 1-3 may be formed by photochemically etching a copper clad surface of another dielectric sheet 118 (e.g. also Teflon/-fiberglass having a relative permittivity of 2.17). The relevant dimensions of the radiator 100 are in terms of the electrical wavelength within dielectric sheet 118 and/or free space as will be appreciated by those in the art. In the exemplary embodiment of FIGS. 1-3, the dielectric sheets 116, 118 and their associated photochemically etched copper clad surfaces are maintained at the desired separated spacing by an expanded dielectric structure 120 (e.g. a honeycomb shaped structure having a relative permittivity approximately equal to that of air or free space).

The width W of the microstrip feedline segment on which the coupling locations 112, 114 are disposed is chosen so as to provide a substantially matched impedance coupling to the overlying radiator area 100. This dimension can, for example, be straightforwardly determined by minimizing the measured voltage standing wave ratio (VSWR) in the feed transmission system. In the exemplary embodiment of FIGS. 1-3 for operation at 4.3 gigahertz with the relative dimensions previously given, the optimum width W has been chosen as approximately 0.35 inches which provides a microstrip transmission line segment having an r.f. impedance of approximately 20 ohms with respect to the underlying ground plane surface 102. Since the horizontally extending arms of the "T" transmission line segments in FIG. 3 are effectively connected in parallel at the short circuit points 108, 110, they have a narrower width corresponding to a relatively higher r.f. impedance which, when added in parallel at their juncture, substantially matches the lower impedance of the vertical segment on which the predetermined coupling locations 112, 114 are located.

FIG. 4 schematically depicts a single radiator element 400 fed by a pair of substantially symmetrical "T" microstrip transmission line segments 402, 404 similar to the FIGS. 1-3 embodiment. However, the transmission line is connected to an unbalanced feed (e.g. the center conductor of a coaxial cable having its shield connected to the ground plane) at feedpoint 406 and, accordingly, includes a half wavelength line segment 408 between the two T sections of strip transmission line. Once again, for reasons already explained with respect to FIGS. 1-3, the open circuited terminations of the "T" strip line sections will transform back to short circuits one-fourth wavelength away from points 410, 412 which, in turn, define predetermined coupling locations 414, 416 disposed proximate predetermined corresponding matched impedance feedpoint regions near the center of radiator 400. The relatively strong concentrated electromagnetic fields thus generated at coupling locations 414, 416 thus provide a strong matched impedance nonconductive coupling to the overlying resonantly dimensioned radiator plate 400.

FIG. 5 schematically depicts yet another embodiment similar to the embodiments of FIGS. 1-3 and of FIG. 4 except that now only a single "T" transmission line structure is employed (with an unbalanced feedpoint as in FIG. 4) so as to define but a single coupling location 502 proximate a predetermined feedpoint region of the overlying radiator element 504. As will be appreciated by those in the art, a single feedpoint to a dual slot microstrip radiator structure may be sufficient so long as its non-resonant dimension is substantially less than one wavelength (e.g. no more than about 0.8 wavelength).

The multiple radiator (i.e. array) antenna systems of FIGS. 6 and 7 should be substantially self-explanatory in view of the embodiments of FIGS. 1-5 previously discussed. For example, in FIG. 6, a balun feed 600 feeds a pair of "T" shaped transmission line structures similar to those already described with respect to FIGS. 1-3. However, instead of positioning the two defined coupling locations 602, 604 proximate different portions of the same radiator structure, in FIG. 6, each such coupling location on the feedline structure is positioned proximate a matched feedpoint region of a respectively corresponding different radiator structure 606, 608.

An unbalanced input feed (e.g. the center conductor of a coaxial cable) is used in FIG. 7 to feed a corporate structured microstrip transmission line at 700. The corporate structured transmission line then provides equally phased, equal amplitude feeds to each of four different "T" feedline sections (similar to those earlier described) 702, 704, 706 and 708 which are individually disposed proximate respectively corresponding radiator structures 710, 712, 714 and 716 as shown in FIG. 7. Accordingly, FIG. 7 merely represents a four element array of the FIG. 5 embodiment where each of the "T" feedline structures is fed from a corporate structured feedline.

Of course, it should be realized that the embodiments shown in FIGS. 4-7 are only schematically shown in these figures but that each of these embodiments actually includes a ground plane or reference surface above which separate respective layers of microstrip feedline structures and microstrip radiator structures are disposed in the same manner shown at FIGS. 1-3. These feedline and radiator structures are typically all formed by photochemically etching copper clad surfaces of dielectric substrates, etcetera as described more explicitly with respect to FIGS. 1-3. All of the remaining exemplary embodiments of FIGS. 8-13 have also been designed, in these exemplary embodiments, for operation at a center frequency of 4.3 gigahertz and have the same general construction, relative vertical spacings with respect to the ground plane, etcetera as earlier described with respect to FIGS. 1-3.

The embodiment schematically depicted in FIG. 8 provides plural coupling locations along the transverse nonresonant dimension of each of a pair of extended length rectangular microstrip radiators. As will be appreciated by those in the art, when the transverse nonresonant dimension of such a radiator approaches or exceeds one wavelength, then it is usually preferred to provide multiple feedpoints of similar phase along the transverse dimension (spaced not more than one wavelength apart) of each such radiator. In the embodiment of FIG. 8, each radiator has a transverse dimension of approximately 2.5 inches. Since a wavelength at 4.3 gigahertz is approximately 2.8 inches in air or free space, it follows that at least two feedpoints should be provided for optimum operation of such a radiator. Since in the exemplary embodiment the upper dielectric sheet on which the radiator structures 800, 802 are formed has a relative permittivity of 2.17, the half wavelength resonant dimension is about one inch in this medium. Actually the effective permittivity seen by the radiator is a combination of the (1) 2.17 cover material; (2) the honeycomb; and (3) the feed circuit board. On the other hand, since the lower dielectric sheet on which the feed transmission line structure is formed has a relative permittivity of about 2.5 (in the exemplary embodiment), a half wavelength in this medium is somewhat shorter which explains why the half wavelength coupling tab portions 804, 806, 808 and 810 of the feedline system have a different physical dimension. Their electrical dimensions are the same half wavelength as depicted in FIG. 8.

The microstrip transmission line structure shown in FIG. 8 comprises segments having four different widths and hence four different r.f. impedances with respect to the underlying ground plane (against which the feed structure is fed by an unbalanced feedpoint such as the center conductor of a coaxial cable at point 812). The narrowest transmission line segments in the exemplary embodiment of FIG. 8 have a width of approximately 0.020 inches (approximately 100 ohms r.f. impedance); the next wider transmission line segments have a width of approximately 0.050 inches (approximately 70 ohms impedance); the next wider transmission line segments have a width of approximately 0.088 inches (approximately 50 ohms impedance) while the widest portion of the feedline system comprise a coupling tab portion having a width of approximately 0.350 inch (20 ohms r.f. impedance to the underlying ground plane).

As shown in FIG. 8, two 100 ohm line segments are connected in parallel at feedpoint 812 so as to present a nominal 50 ohm input impedance matched to a coaxial cable or the like connected thereto. Progressing from the feedpoint to the right in FIG. 8 through the 100 ohm line section, a 70 ohm transformer line section is next encountered whereby the impedance of the transmission line is transformed from 100 ohms to 50 ohms at the vertically directed right angle junction which then connects to a coupling tab portion (e.g. 806) having an impedance of about 20 ohms. As is conventional practice, a tapered transistion region is provided between the 50 ohm line segment and the 20 ohm line segment.

Another 50 ohm line segment (one-half wavelength long so as to obtain proper phasing) is connected in parallel at the base of the coupling tab portion 806 to feed the oppositely directed coupling tab portion 810 therebelow as shown in FIG. 8. An exactly similar feed system extends to the left of feedpoint 812 as shown in FIG. 8 and as should now be appreciated.

Each of the coupling tab portions of the transmission line shown in FIG. 8 terminates in an r.f. open circuit. As should be appreciated, the r.f. open circuit will transform back to an effective r.f. short circuit one-fourth wavelength therefrom. Located another one-fourth wavelength from the effective r.f. short circuit point are predetermined coupling locations 814, 816, 818 and 820 denoted by asterisks in FIG. 8. As may also be seen by the dotted line superposition of the overlying radiator structures 800, 802, these predetermined coupling locations are disposed proximate corresponding predetermined feedpoint regions on the radiator structures such that the intensely concentrated electromagnetic fields that may be expected to occur at the coupling locations provide an efficient nonconductive electromagnetic coupling between the feedline system and the radiator structures. As previously explained, the r.f. impedance of the coupling tab portions is chosen so that a substantially matched impedance coupling to the feedpoint regions on the radiating structures is achieved. Typically, such matched impedance coupling condition is achieved by experimental determination using different widths for the coupling tab portions and noting the voltage standing wave ratios in the feedline system which result for the different widths. The optimum width (i.e. matched impedance condition) corresponds to the minimum measured voltage standing wave ratio.

The dimensions previously mentioned with respect to these exemplary embodiments have been determined as approximately optimum merely for the particular geometry and operating frequency of these exemplary embodiments.

The embodiment shown in FIG. 9 is substantially similar to that shown in FIG. 8. However, in FIG. 9, the coupling tab portions 900, 902, 904, and 906 are only one-fourth wavelength in their longitudinal dimension rather than one-half wavelength as in FIG. 8. Here, in FIG. 9, actual conductive r.f. short circuits have been provided at points one-fourth wavelength from the predetermined coupling locations 908, 910, 912 and 914. These r.f. short circuits can be provided using any conventional technique such as, for example, by passing conductive tapes through cut slots in the underlying dielectric substrate and soldering the conductive tape to the end of each coupling tab portion and to the underlying ground plane surface. Alternatively, conventional conductively plated through holes or conductive rivets may be used to provide an effective r.f. short circuit. If the latter technique is employed, such holes and/or rivets are typically provided approximately every one-tenth wavelength or less. In the exemplary embodiments, three conductive rivets are provided at spaced apart locations along the terminating end of each coupling tab portion 900, 902, 904 and 906.

The embodiment of FIG. 9 has shown improved second harmonic suppression over the embodiment of FIG. 8. Without such superior suppression of second harmonics, for some applications it may be necessary to provide additional r.f. short circuits one-fourth wavelength from the input feedpoint 812 of the FIG. 8 embodiment. If provided, they act as r.f. short circuits (i.e. one-half wavelength from the input point) at the second harmonic of the intended antenna operating frequency.

As will be noted from FIG. 9, the shape of the transversely directed edges of the radiator structures is not critical. Here, these ends are rounded. Although two radiators are explicitly depicted in FIG. 9 so that the operation could be explained as being substantially analogous to that of the FIG. 8 embodiment, it should also be noted that it is possible to dispose a single similar radiator structure above the four coupling locations defined in either FIG. 8 or 9 thus coupling to four corresponding feedpoint regions of the single radiator structure (two on either of its transversely directed edges).

The embodiment of FIG. 10 is directed to such a single radiator system where only two coupling tab portions 1000, 1002 are provided. Here again, an unbalanced feedpoint 1004 is connected to a short segment of approximately 50 ohm line which, in turn, feeds two parallel half wavelength 100 ohm line sections connected to feed coupling tab 1002. Coupling tab 1000 is directly fed as shown in FIG. 10. As also depicted in FIG. 10, the coupling tab portions 1000, 1002 are each one-fourth wavelength long and terminate in r.f. short circuits to the underlying ground or reference plane. This results in the definition of predetermined coupling locations 1006, 1008 which are disposed proximate predetermined corresponding feedpoint regions of the radiator 1010.

The embodiment of FIG. 11 is substantially similar to that of FIG. 10 except that coupling tab portions are extended to one-half wavelength in length and thus terminate in r.f. open circuits. As previously described, such open circuit terminations transform back to effective r.f. short circuits at one-fourth wavelength. At a further one-fourth wavelength distance, predetermined coupling locations are defined as should now be apparent.

The embodiment of FIG. 12 is substantially the same as that of FIG. 11 except that the coupling tab portions are extended into "T" shaped sections as in the embodiments of FIGS. 1–7. As should now be apparent, this structure defines coupling locations at points 1200 and 1202 which are disposed proximate corresponding feedpoint regions in the overlying radiator surface 1204.

All of the foregoing exemplary embodiments may, if desired, be physically realized by structures such as that shown in FIG. 13 in expanded or exploded format. Here, bonding films 1300 are provided between the radiator structure substrate 1302 (having a photochemically etched resonantly dimensioned radiator structure on its underside), an expanded dielectric spacer 1304 (e.g. a honeycomb shaped dielectric structure), a microstrip transmission feedline structure substrate 1306 (having a photochemically etched microstrip transmission line structure on its top surface) and a metallic antenna housing 1308 (which in this instance also serves as the electrically conductive reference or ground plane structure). The feedline substrate 1306 typically includes a plated through hole so that the upper end of a center conductor connector pin 1310 may be easily solder connected to the feedline structure. Of course, the other end of the pin 1310 comprises a part of a standard coaxial cable connector 1312. If desired, an O-ring 1314 may be provided as shown in FIG. 13 so as to make a gas tight seal between the coaxial cable connector and the antenna housing. In this manner, the interior of the antenna structure may be completely evacuated or filled with any desired gaseous filling, etcetera. As should be appreciated, when the expanded structure depicted in FIG. 13 is actually assembled, the outer edges of the radiator structure substrate 1302 will be bonded via the bonding film 1300 to the outer edges of the metallic antenna housing to complete the hermetic sealing of all active antenna elements.

In all the above-discussed embodiments, it is possible to adjust the impedance match by (1) moving the "predetermined coupling" location and/or (2) adjusting the width of the coupling tab. Although the exemplary embodiments have used "widened" coupling tabs, some embodiments may require relatively narrowed coupling tabs. The important thing is to achieve a matched impedance coupling.

Although only a few exemplary embodiments of this invention have been described in detail above, those skilled in the art will recognize that many variations and modifications may be made in the exemplary embodiments while still retaining many of the novel features and advantages of this invention. Accordingly, all such variations and modifications are intended to be included within the scope of the appended claims.

What is claimed is:

1. A microstrip antenna system comprising:

an electrically conductive reference surface;

a layer of electrically conductive microstrip radiator structure disposed above said reference surface by a first predetermined distance less than one-tenth wavelength at the intended antenna operating frequency, said radiator structure including at least one conductively isolated two dimensional conductive area having a resonant dimension of substantially one-half wavelength at said operating frequency; and a layer of electrically conductive microstrip feedline structure disposed intermediate said reference surface and said layer of radiator structure, said feedline structure including at least one predetermined coupling location positioned an odd integer number of one-fourth wavelength(s) from an effective r.f. short circuit to the underlying reference surface thus causing a concentration of electromagnetic fields to occur at the coupling location which is also disposed proximate to a predetermined corresponding feedpoint region of said radiator structure such that the concentrated electromagnetic fields operate to nonconductively couple r.f. energy to/from said radiator structure from/to said feedline structure.

2. A microstrip antenna system as in claim 1 wherein said feedline structure includes strip transmission line segments having different widths and hence different r.f. impedances and wherein said coupling location is disposed at a widened lowered r.f. impedance coupling tab segment of the line having a width dimension which is widened sufficient to provide a matched impedance condition at the the corresponding feedpoint region but which width dimension is nevertheless substantially less than the dimension of said radiator structure in a direction transverse to its resonant dimension.

3. A microstrip antenna system as in claim 2 wherein said coupling tab segment has a longitudinal axis disposed substantially parallel with respect to the resonant dimension of the overlying radiator structure.

4. A microstrip antenna system as in claim 1, 2 or 3 wherein said effective r.f. short circuit is provided by a conductive connection to the underlying reference surface.

5. A microstrip antenna system as in claim 1, 2 or 3 wherein said effective r.f. short circuit is provided by an r.f. open circuit termination located one-fourth wavelength therefrom along the feedline structure at the intended antenna operating frequency.

6. A microstrip antenna system as in claim 2 or 3 wherein said coupling tab segment has a length of approximately one-fourth wavelength at the intended antenna operating frequency and terminates in a conductive r.f. short circuit to the reference surface.

7. A microstrip antenna system as in claim 2 or 3 wherein said coupling tab segment has a length of approximately one-half wavelength at the intended antenna operating frequency and terminates in an r.f. open circuit.

8. A microstrip antenna system as in claim 1, 2 or 3 wherein:

said reference surface and said feedline structure are provided by metallically-cladded opposite sides of a first dielectric sheet; and said radiator structure is provided by a metallically-cladded side of a second dielectric sheet.

9. A microstrip antenna system as in claim 8 further comprises an expanded dielectric structure disposed between said first and second dielectric sheets.

10. A microstrip antenna system comprising:

an electrically conductive reference surface;

a layer of electrically conductive microstrip radiator structure disposed less than one-tenth wavelength above said reference surface at the intended antenna operating frequency, said radiator structure including a plurality of conductively isolated and unconnected two dimensional shaped conductive areas each of which has a resonant dimension of substantially one-half wavelength at said operating frequency;

a layer of electrically conductive microstrip feedline structure disposed between said reference surface and said layer of radiator structure, said feedline structure including a plurality of widened coupling tab segments having lowered r.f. impedances, as compared to other segments of the feedline structure, said coupling tab segments each defining at least one predetermined coupling location positioned one-fourth wavelength from an effective r.f. short circuit to the underlying reference surface and wherein each of said coupling locations is positioned proximate a corresponding predetermined feedpoint region of said radiator structure, there being at least one such feedpoint region on each of said shaped conductive areas; and r.f. input/output means connected to couple r.f. signals to/from said feedline structure with respect to said reference surface which signals are, in turn nonconductively coupled to/from said radiator structure via said matched coupling locations and feedpoint regions.

11. A microstrip antenna system as in claim 10 wherein said coupling tab segments have a width dimension which is substantially less than the dimension of a shaped conductive area of the radiator structure in a direction transverse to said resonant dimension.

12. A microstrip antenna system as in claim 10 wherein said coupling tab segments each have a longitudinal axis disposed substantially parallel to the resonant dimension of a corresponding overlying radiator structure conductive area.

13. A microstrip antenna system as in claim 10, 11 or 12 wherein said effective r.f. short circuit is provided by a conductive connection to the underlying reference surface.

14. A microstrip antenna system as in claim 10, 11 or 12 wherein said effective r.f. short circuit is provided by an r.f. open circuit located one-fourth wavelength therefrom along the feedline structure at the intended antenna operating frequency.

15. A microstrip antenna system comprising:

an electrically conductive reference surface;

a thin layer of electrically conductive microstrip feedline structure disposed above said reference surface by a first predetermined distance and dimensioned with respect to an intended antenna operating frequency to produce regions of relatively intense electromagnetic fields at predetermined coupling location(s);

r.f. feed means connected to said feedline structure and to said reference surface for feeding r.f. signals to/from the feedline structure with respect to said reference surface at said intended antenna operating frequency; and a thin layer of electrically conductive microstrip radiator structure disposed above said reference surface by a second predetermined distance which is greater than said first predetermined distance and which is also less than approximately one-tenth wavelength at the intended antenna operating frequency, said radiator structure having a resonant dimension of substantially one-half wavelength at the antenna operating frequency and a transverse dimension of at least one-half wavelength at the antenna operating frequency so as to define radiating slots along transversely directed edges of the radiator structure;

said radiator structure having predetermined feedpoint regions located above and proximate said coupling locations of the underlying feedline structure and substantially matched in r.f. impedance therewith such that r.f. signals are efficiently coupled electromagnetically thereat to/from said radiator structure from/to said feedline structure.

16. A microstrip antenna system as in claim 15 wherein said feedline structure includes an r.f. open circuit end portion located an integer number of one-half wavelength(s) from said coupling location(s) at said intended antenna operating frequency.

17. A microstrip antenna system as in claim 15 wherein said feedline structure includes a conductive r.f. short circuit to said reference surface located an odd integer number of one-fourth wavelengths from said coupling location(s) at said intended antenna operating frequency.

18. A microstrip antenna system as in claim 15 wherein said feedline structure includes coupling tab portions extending from spaced apart locations along a relatively more narrow feedline portion, said coupling tab portions being approximately one-half wavelength in length at the intended atenna operating frequency and terminating in an r.f. open circuit.

19. A microstrip antenna system as in claim 15 wherein said feedline structure includes coupling tab portions extending from spaced apart locations along a relatively more narrow feedline portion, said coupling tab portions being approximately one-fourth wavelength in length at the intended antenna operating frequency and terminating in a conductive r.f. short circuit to the reference surface.

20. A microstrip antenna system as in claim 15, 18 or 19 wherein said coupling location(s) are defined by relatively widened elongated coupling tab portion(s) extending parallel to the resonant dimension of the overlying radiator structure.

21. A microstrip antenna system as in claim 15, 16, 17, 18 or 19 wherein:

said feedline structure is provided by a metallically-cladded side of a first dielectric sheet; and said radiator structure is provided by a metallically-cladded side of a second dielectric sheet.

22. A microstrip antenna system as in claim 21 further comprising an expanded dielectric structure disposed between said first and second dielectric sheets.

23. A microstrip antenna system as in claim 15 wherein said r.f. feed means comprises a balun means providing balanced feed to/from a symmetrical feedline structure.

* * * * *